US011193095B2

(12) United States Patent
Hitchcock et al.

(10) Patent No.: US 11,193,095 B2
(45) Date of Patent: Dec. 7, 2021

(54) RINSING SOLUTION FOR METAL BLADES

(71) Applicant: Wizard Labs, LLC, Jamestown, NC (US)

(72) Inventors: Wiley William Hitchcock, Greensboro, NC (US); James Michael Puckett, High Point, NC (US)

(73) Assignee: Wizard Labs, LLC, Jamestown, NC (US)

( * ) Notice: Subject to any disclaimer, the term of this patent is extended or adjusted under 35 U.S.C. 154(b) by 18 days.

(21) Appl. No.: 16/740,962

(22) Filed: Jan. 13, 2020

(65) Prior Publication Data

US 2020/0224131 A1 Jul. 16, 2020

Related U.S. Application Data

(60) Provisional application No. 62/792,134, filed on Jan. 14, 2019.

(51) Int. Cl.

| | |
|---|---|
| ***C11D 11/00*** | (2006.01) |
| ***C11D 1/62*** | (2006.01) |
| ***C11D 3/04*** | (2006.01) |
| ***B08B 3/08*** | (2006.01) |
| ***C11D 3/20*** | (2006.01) |
| ***C11D 3/43*** | (2006.01) |

(52) U.S. Cl.

CPC ..... *C11D 11/0029* (2013.01); *B08B 3/08* (2013.01); *C11D 1/62* (2013.01); *C11D 3/046* (2013.01); *C11D 3/201* (2013.01); *C11D 3/2017* (2013.01); *C11D 3/43* (2013.01)

(58) Field of Classification Search

CPC ..... C11D 11/0029; C11D 1/62; C11D 3/043

See application file for complete search history.

(56) References Cited

U.S. PATENT DOCUMENTS

| | | | | |
|---|---|---|---|---|
| 2007/0149435 | A1* | 6/2007 | Koenig | C11D 3/1213 510/384 |
| 2009/0275493 | A1* | 11/2009 | Siegert | A61K 8/66 510/320 |
| 2010/0234269 | A1* | 9/2010 | Dreilinger | C11D 3/044 510/405 |
| 2015/0144502 | A1* | 5/2015 | Keswani | C25F 1/00 205/687 |
| 2017/0283743 | A1* | 10/2017 | Trebbe | B05C 17/00553 |
| 2017/0321164 | A1* | 11/2017 | Kropf | C11D 3/28 |
| 2018/0193510 | A1* | 7/2018 | Hitchcock | A61K 8/34 |
| 2018/0271769 | A1* | 9/2018 | Ghandi | A01N 57/34 |
| 2018/0289848 | A1* | 10/2018 | Hitchcock | A61K 8/922 |
| 2020/0224131 | A1* | 7/2020 | Hitchcock | C11D 11/0029 |

OTHER PUBLICATIONS

A short CN 109732196 at East Search Result. (Year: 2019).*

* cited by examiner

*Primary Examiner* — Nicole M. Buie-Hatcher
*Assistant Examiner* — M. R. Asdjodi
(74) *Attorney, Agent, or Firm* — Kilpatrick Townsend & Stockton LLP

(57) ABSTRACT

A blade rinse composition comprising about 0.0001 to 0.01 wt. % disodium tetraborate decahydrate, about 0.0001 to 0.01 wt. % cationic surfactant, up to 5 wt. % anhydrous alcohol, and deionized water is disclosed, together with methods of making and using the same. The composition may prevent oxidation and/or contamination of metal blades and premature dullness of the blades.

8 Claims, 18 Drawing Sheets

| Test Day | Center Build Up | Left / Right Side build up |
|---|---|---|
| | Example 1 Solution applied to razor | |
| 20-Days |  |  |
| | Comparative Solution applied to razor | |
| 20-Days |  |  |
| | Control Razor - Hard Water ONLY | |
| 20-Days |  |  |

RINSING SOLUTION FOR METAL BLADES

PRIORITY

This application claims priority to U.S. Provisional Application No. 62/792,134, filed on Jan. 14, 2019, which is incorporated herein by reference in its entirety.

FIELD

Described herein are compositions and methods for preventing oxidation and/or contamination of metal blades, and methods of using the compositions. In embodiments, the composition and methods prevent deposition of hard water minerals on metal blades.

BACKGROUND

Metal blades such as razor blades generally lose their effectiveness with use and subsequent cleaning. In some service conditions, metal blades can oxidize (e.g rust) or become prematurely dull and need to be replaced at shortened intervals than desirable. Replacement of metal blades can be costly and a need exists to extend the life of metal blades. Conventional blade preservation approaches may include oil rinses, magnetic mineral stripping, and acidic demineralizing solutions, which can be burdensome on a user. Other conventional means may use messy or corrosive solutions that involve storing the blades in a specialized wet vessel between uses that can prematurely dissolve the moisturizing strips found on many blades.

SUMMARY

Described herein are methods and compositions to extend the usable life of metal blades, such as razor blades used for shaving. The methods may prevent rust and contamination of metal blades, and can allow for blade storage practices to remain unchanged. The methods described herein can be inexpensive, effective, and convenient for the end user.

Metal blades can be used in a wet environment that includes mineral-rich water, including tap water. In the case of hard water, these minerals are mainly calcium and magnesium, both divalent ions. The minerals in the water can form layers of mineral deposits on the blade as the blade dries. These mineral deposits can lead to rust or contamination of the metal blade and reduce the usable lifespan of the blade. A layer of crystalline mineral deposits can form on the sharp edge of the blade and may cause the blade to become prematurely dull.

In some embodiments, a blade rinse composition may comprise about 0.0001 to 0.01 wt. % disodium tetraborate decahydrate, 0.0001 to 0.01 wt. % cationic surfactant, up to 10 wt. % anhydrous alcohol, and deionized water. In some embodiments, a blade rinse composition may comprise about 0.0001 to 0.01 wt. % disodium tetraborate decahydrate, up to 10 wt. % anhydrous alcohol, and deionized water. In some embodiments, a blade rinse composition may comprise 0.0001 to 0.01 wt. % cationic surfactant, up to 10 wt. % anhydrous alcohol, and deionized water. In certain embodiments, the cationic surfactant may be benzalkonium chloride. The cationic surfactant may have antimicrobial function. In certain embodiments, the anhydrous alcohol may comprise methanol, ethanol, or isopropanol.

In some embodiments, the deionized water may be substantially ion-free. For example, the deionized water may have a resistivity of 10-18 megaohm. In some embodiments, the deionized water may have a resistivity of 16-18 megaohm. In some embodiments, the solution may be ion-binding. In certain embodiments, the solution may bind divalent ions, such as calcium, magnesium, and iron.

In some embodiments, a method of making an blade rinse composition may compromise obtaining deionized water having a resistivity of 10-18 megaohm, adding disodium tetraborate decahydrate to the deionized water to form a deionized water mixture, preparing a second mixture of cationic surfactant and anhydrous ethanol, and adding the second mixture to the deionized water mixture.

Also described herein are methods of using a blade rinsing composition. In some embodiments, a method for using the composition described herein minimizes the deposition of hard water minerals on a metal substrate. In certain embodiments, the method can further comprise spraying the composition on the metal substrate. In certain embodiments, the method may further comprise at least partially submerging the metal substrate in the composition. In some embodiments, the metal substrate may be a razor blade, knife blade, or scissors.

Further embodiments may include an article of manufacture comprising the composition described herein.

BRIEF DESCRIPTION OF THE DRAWINGS

The invention may be further understood by reference to the following non-limiting figures.

DETAILED DESCRIPTION

Figure 1:
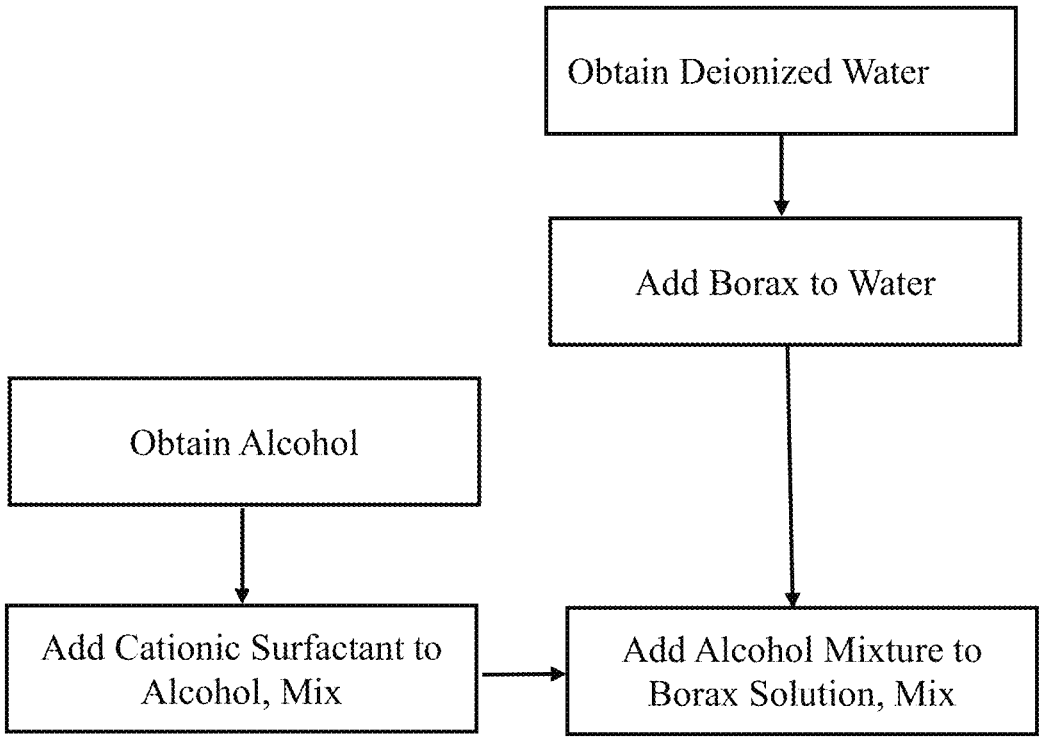
FIG. 1 is a flowchart diagram of a process for making a blade rinsing composition according to one example of the present disclosure.

Embodiments of the present invention include a blade rinsing composition, methods of producing the same, methods for using the same. The methods described herein may be inexpensive, effective, and convenient for the end user.

The invention may be embodied in a variety of ways. In some embodiments, a blade rinse composition may comprise about 0.0001 to 0.01 wt. % disodium tetraborate decahydrate (borax), 0.0001 to 0.01 wt. % cationic surfactant, up to 5 wt. % anhydrous alcohol, and the remainder deionized water. In certain embodiments, a blade rinse composition may comprise about 0.0001 to 0.0005 wt. % disodium tetraborate decahydrate, 0.0001 to 0.0005 wt. % cationic surfactant, up to 5 wt. % anhydrous alcohol, and the remainder deionized water.

In some embodiments, the cationic surfactant may be benzalkonium chloride. In some cases, the benzalkonium chloride may act as a disinfecting agent.

In some embodiments, the anhydrous alcohol may comprise methanol, ethanol, or isopropanol. The composition may comprise up to 5 wt. % alcohol. In some embodiments, the composition may comprise at least 0.1 wt. % alcohol. The alcohol can break up the surface tension of the solution, and act as a quick-dry agent to reduce the time for the blade to dry. In some cases, the alcohol may add oil removal capacity to the rinsing solution. Oils from shave cream and soap can remain on the blade after a rinse with tap water.

In some embodiments, the deionized water may be substantially ion-free. In some embodiments, the deionized water can have a resistivity of 10-18 megaohm. In certain embodiments, the deionized water may have a resistivity of 16-18 megaohm. Ultrapure deionized water can scavenge and solubilize minerals from the metallic surfaces of the metal blades that were deposited on the blade during the normal use process that includes tap water or other potable water. The razor can then be stored as normal, preferably in a dry place.

In some embodiments, the maximum total dissolved ionic content of the solution may be less than 5-10 ppm. In certain embodiments, the maximum total dissolved ionic content may be 2 ppm or less. In some embodiments, the solution may be ion-binding. In certain embodiments, the solution may bind divalent ions, such as calcium, magnesium, and iron.

In some embodiments, the solution may be antifungal, antibacterial, and/or antiviral. In some embodiments, the solution may meet EPA guidelines for wastewater and effluent. In some embodiments, the solution may evaporate quickly and reduce drying time. In some embodiments, the solution may be skin-safe and non-irritating. In some embodiments, the solution may be non-damaging to metals and polymeric materials. In some embodiments, the solution may be non-damaging to marble, quartz, porcelain, acrylic, melamine, or other materials commonly used in the sinks, tubs, and countertop materials.

The blade rinsing solution described herein can extend the usable life of shaving razor blades, knife blades, scissor blades, or other metal blades. Tap water used to clean metal blades after cleaning can be mineral-rich and leave hard water deposits that form on the blade as it dries. These hard water deposits can form a layer of crystalline mineral deposits on the sharp edge of the blade that can cause the blade to prematurely dull. The minerals deposition may start at the fastest drying parts on the blade, the sharp edge of the blade. Once the crystals form, they can seed for the growth of future crystal deposits and a crystal layer can quickly form over the sharp edge of the razor blade. This process can cause a premature dulling effect. The blade rinsing solution described herein can prevent these mineral deposits from forming, and can allow for the sharp edge of the blade to remain substantially free of mineral deposits and remain sharp until the metal naturally dulls from use. By preventing these mineral deposits, the sharpness of a razor blade can be extended to a period of months, not days. In some examples, a blade can remain sharp enough to comfortably use for hair removal for a period of 4 to 6 months.

A composition described herein may be advantageously produced by a method of the present invention, as shown in FIG. 1. In some embodiments, a method of making an blade rinse composition may compromise obtaining deionized water having a resistivity of 10-18 megaohm, adding disodium tetraborate decahydrate to the deionized water to form a deionized water mixture, preparing a second mixture of cationic surfactant and anhydrous ethanol, and adding the second mixture to the deionized water mixture.

In some embodiments, a method of making an blade rinse composition may compromise obtaining deionized water having a resistivity of 10-18 megaohm, adding disodium tetraborate decahydrate (borax) to the deionized water to form a deionized water mixture, adding a cationic surfactant to the deionized water mixture, and adding an anhydrous alcohol to the deionized water mixture.

In some embodiments, a method of making a blade rinse solution may compromise adding disodium tetraborate decahydrate (borax) to deionized water in a vessel, preparing a second mixture of cationic surfactant and anhydrous ethanol, adding the second mixture to the vessel, and mixing the solution. In some embodiments, the deionized water may be heated. In certain embodiments, the deionized water may be heated to between 40 to 60° C.

In certain embodiments, the method involves agitating the deionized water during the borax addition. In some embodiments, the borax may be essentially dissolved prior to adding the second mixture to the vessel. In some embodiments, the dissolution of the borax may be analyzed visually by taking a sample of the solution and viewing it using a clear container. Undissolved borax crystals may be visible during the visual analysis, indicating that the borax may not be fully dissolved into the deionized water solution.

Once the borax is essentially dissolved, in some embodiments the method includes agitating the composition during the addition of the subsequent components. In some embodiments, the mixing of the solution may be performed by stirring, shaking, agitating, and/or circulating the composition.

The present method may also comprise preparing a second mixture of cationic surfactant and anhydrous ethanol and adding the second mixture to the solution. The solubility of the cationic surfactant may be higher in alcohol than in water.

Also described herein are methods of using a blade rinsing composition. In some embodiments, a method may include using the composition described herein to minimize deposition of hard water minerals on a metal substrate. In certain embodiments, the method can further comprise spraying the composition on the metal substrate. In certain embodiments, the method may further comprise at least partially submerging the metal substrate in the composition. Optionally, the metal substrate may be shaken, flicked, or tapped to remove excess blade rinsing solution. The substrate or blade may be stored in a dry area.

In some embodiments, the metal substrate may be a razor blade, knife blade, or scissors. In some embodiments, the metal substrate may be metal fixtures, such as door handles, bath fixtures, kitchen fixtures, and the like.

The methods of use described herein are quick and do not add substantial steps to a person's personal care or cleaning routine. The methods do not require specialized storage or require any power source. The composition may be safe for multiple non-metallic surfaces, and may not pose a concern of damage from overspray or spilling.

Also disclosed herein is an article of manufacture comprising the composition described herein. In some embodiments, the article of manufacture may be a spray solution. In other embodiments, the article of manufacture may be a container of liquid solution to enable submersion of the metal substrate to be rinsed.

EXAMPLES

Example 1

| Component | Amount |
|---|---|
| Reagent Alcohol | 1 wt % |
| Borax | 0.0004% = 4 ppm |
| Benzalkonium Chloride | 0.0004% = 4 ppm |
| DiH2O (18 megaohm) | <99 wt. % |

A rinsing solution was prepared by adding reagent alcohol, borax, and benzalkonium chloride to 18 megaohm deionized water and mixing to form a solution.

Example 2

| Component | Amount |
|---|---|
| Reagent Alcohol (ethanol) | 1 wt % |
| DiH2O (18 megaohm) | 99 wt. % |

A rinsing solution was prepared by adding reagent alcohol to 18 megaohm deionized water and mixing to form a solution.

Example 3

Figure 2:
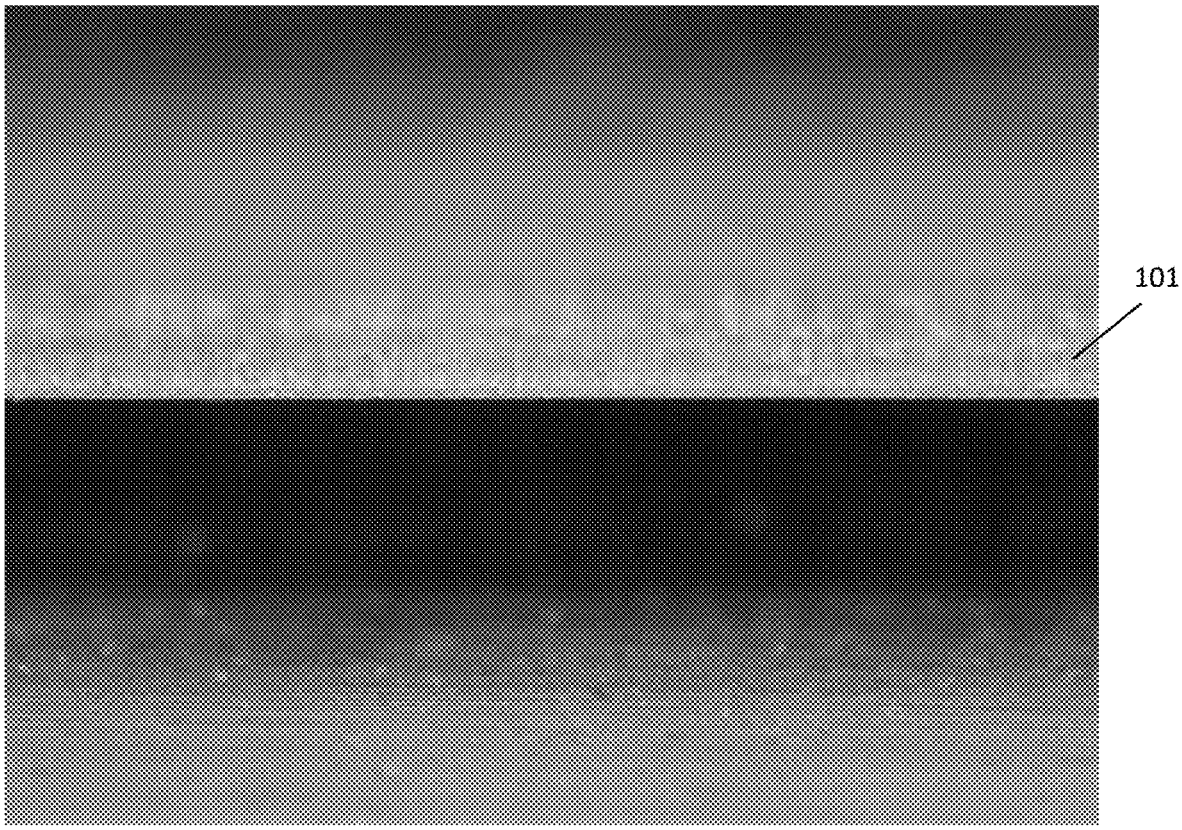
FIG. 2 is a micrograph at 10× magnification of a razor blade treated with a blade rinsing composition according to one example of the present disclosure.
Figure 3:
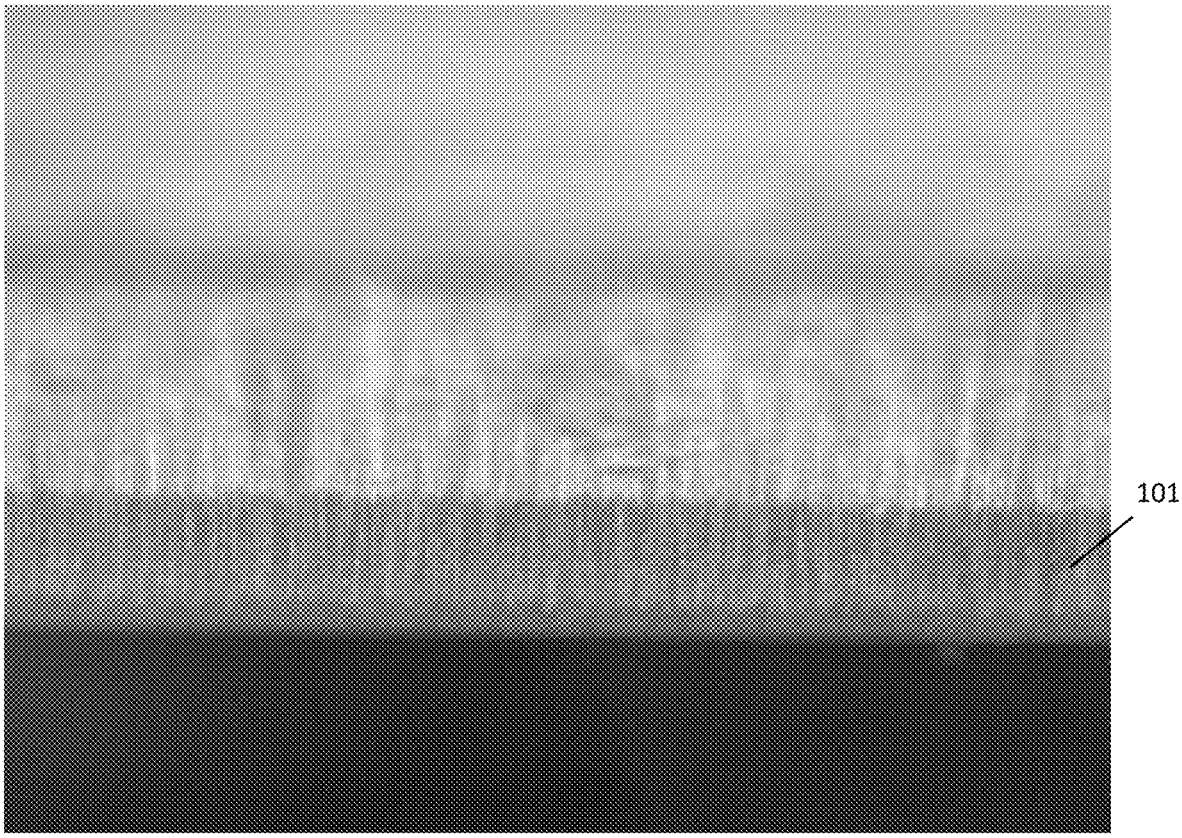
FIG. 3 is a micrograph at 40× magnification of a razor blade treated with a blade rinsing composition according to one example of the present disclosure.
Figure 4:
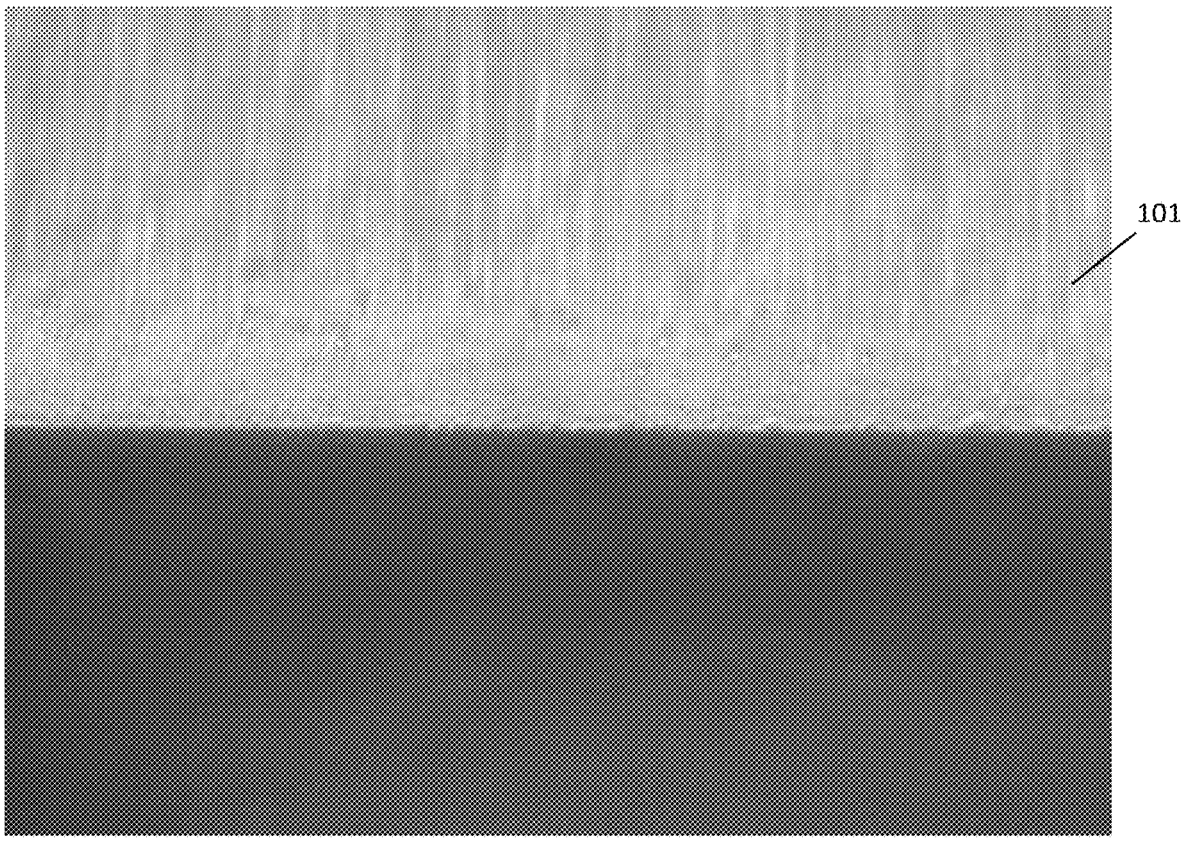
FIG. 4 is a micrograph at 100× magnification of a razor blade treated with a blade rinsing composition according to one example of the present disclosure.
Figure 5:
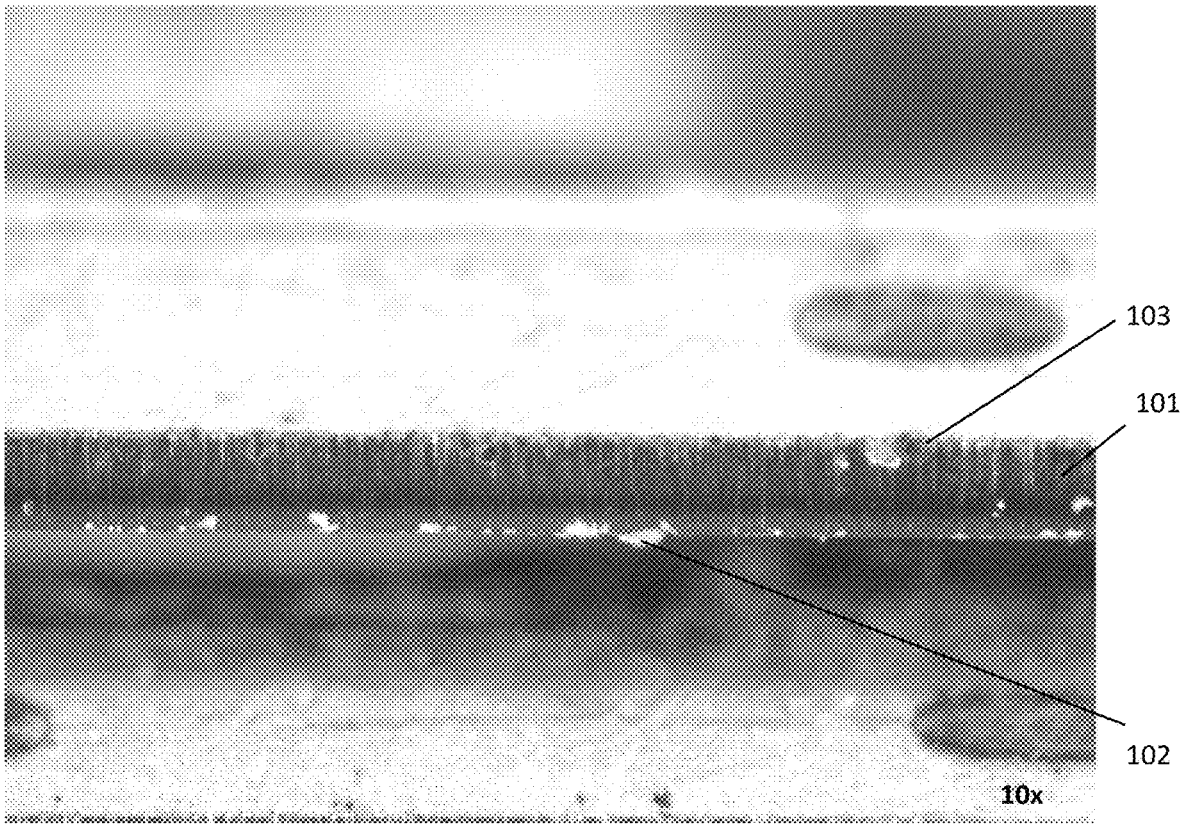
FIG. 5 is a micrograph at 10× magnification of an untreated razor blade after 30-day trial.
Figure 6:
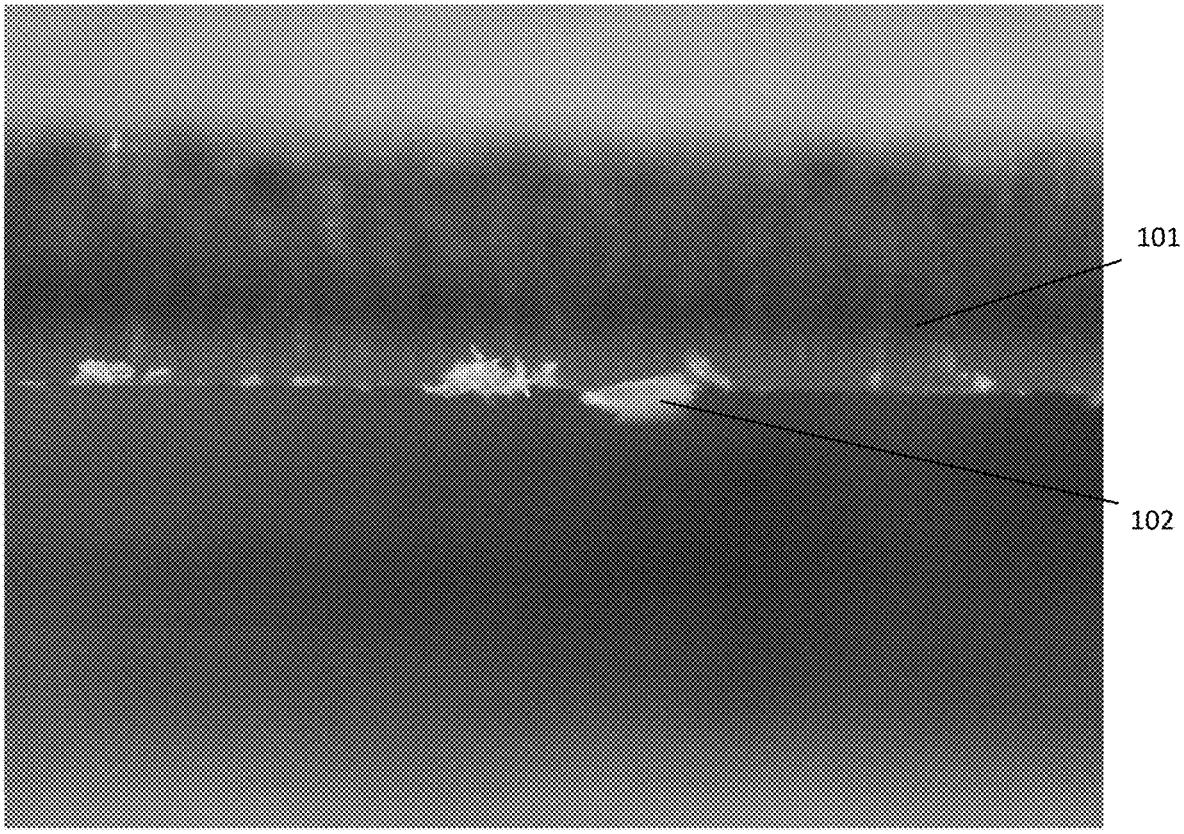
FIG. 6 is a micrograph at 40× magnification of an untreated razor blade after 30-day trial.

An extended trial of the rinsing solution as compared to a standard tap water rinse was conducted. The rinsing solution of Example 2 was prepared. The rinsing solution was sprayed onto a razor blade as a final step after the blade was used for hair removal and rinsed with tap water. The razor was shaken to remove the excess rinsing solution and then stored in a dry place. FIGS. 2-4 show a metal blade 101 that has been treated with the rinsing solution for a period of 4-5 months after regular use of the blade 101. There are no visible mineral crystal deposits on the blade 101 and no visible rust present, at either 10λ, 40λ, or 100× magnification. FIGS. 5 and 6 show a metal blade 101 that was not treated with the rinsing solution, after a period of 4-5 months of regular use of the blade 101, including a tap water rinse. At 10× and 40× magnification, there are visible mineral crystal deposits 102 on the blade 101 and visible rust present 103.

Example 4

Figure 7:
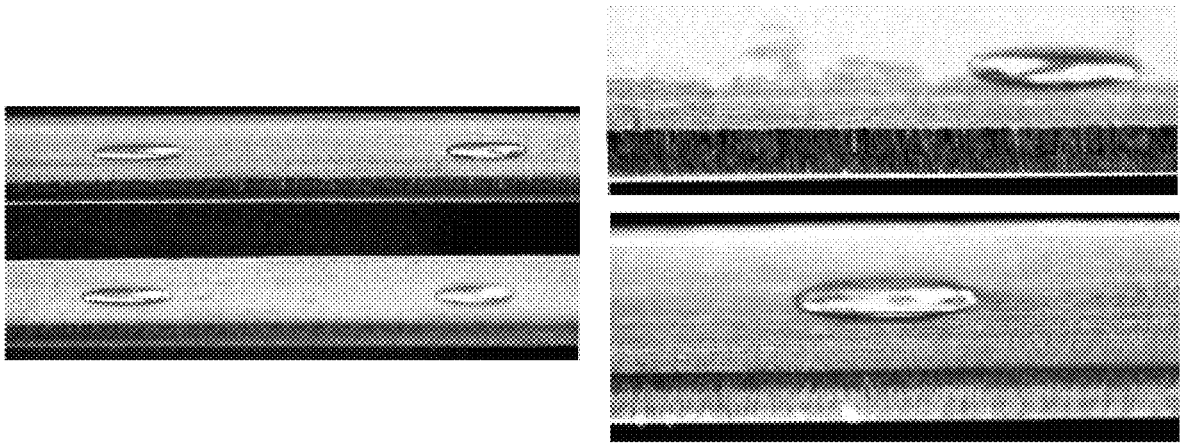
FIG. 7 is a stereoscopic image of new untreated razor blades.

A 30-day performance test was conducted on the rinsing solution as compared to no rinsing solution. The rinsing solution of Example 1 was prepared. A hard water solution was prepared for testing. For the hard water solution, approximately 1200 g of distilled water was mixed with 120 g calcium chloride (Alpha Chemicals) and 90 g of baking soda (Arm & Hammer). The hard water solution was separated into two designated containers. Two Gillette Mach3 razors were obtained, one to be rinsed with the Example 1 solution and one for control (no solution). The razors were triple-blade. FIG. 7 shows images of the blades immediately after removal of retail packaging.

Each razor was submerged in the designated hard water solution and tapped on a bowl's edge 2-3 times to remove excess liquid. The Example 1 razor was then sprayed with the Example 1 solution. The control razor was not sprayed. After submersion, both razors were placed in a temperature-controlled chamber set at 125° F. for approximately 1 hour to dry. Each day, the process was repeated.

Figure 8:
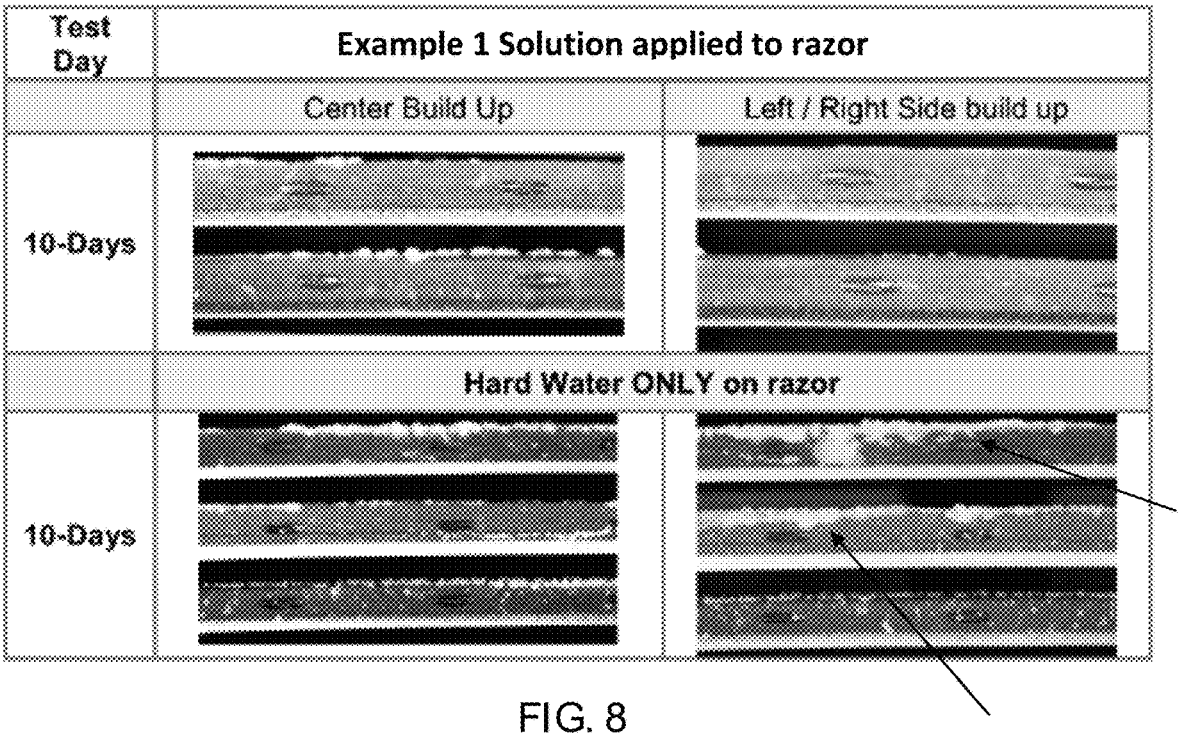
FIG. 8 is a stereoscopic image of razor blades treated with a blade rinsing composition according to one example of the present disclosure and untreated razor blades after 10 days of exposure to a hard water solution.
Figure 9:
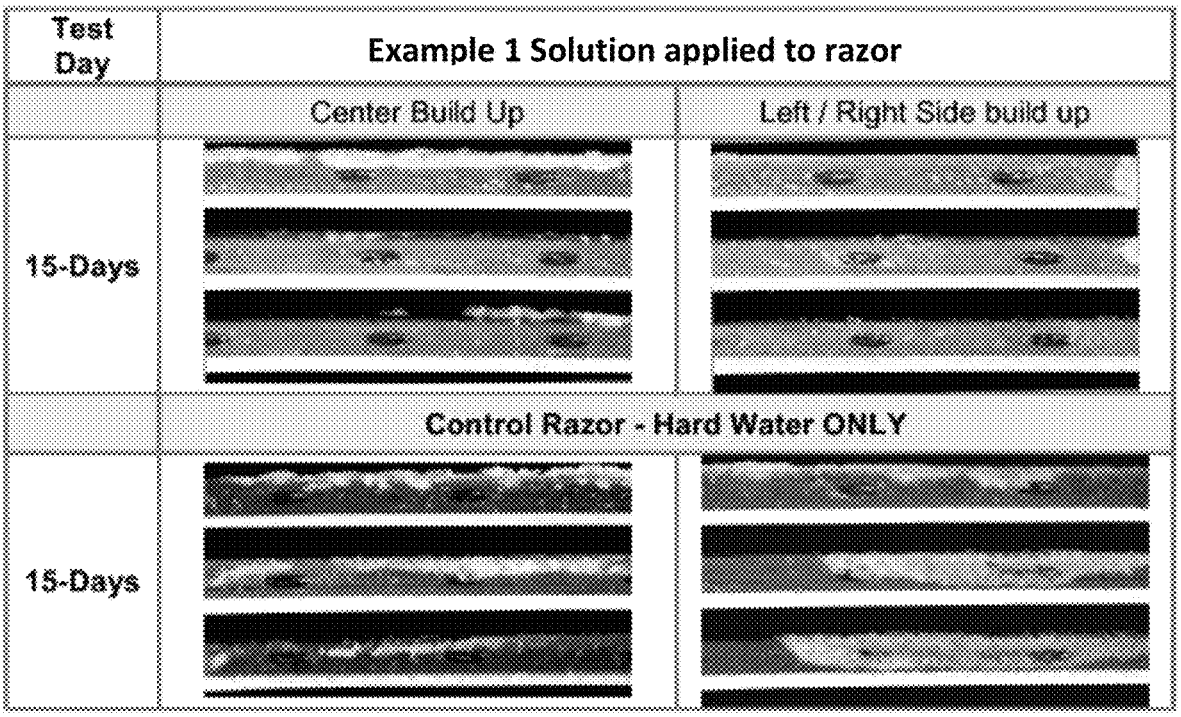
FIG. 9 is a stereoscopic image of razor blades treated with a blade rinsing composition according to one example of the present disclosure and untreated razor blades after 15 days of exposure to a hard water solution.
Figure 10:
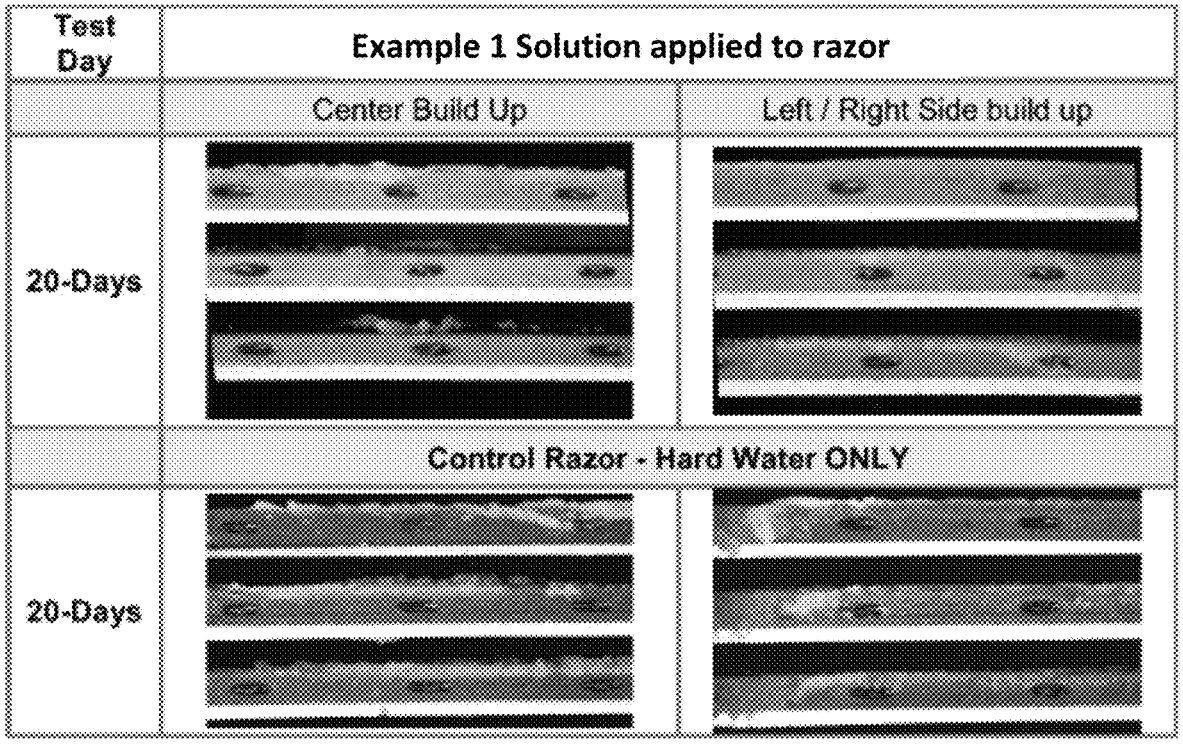
FIG. 10 is a stereoscopic image of razor blades treated with a blade rinsing composition according to one example of the present disclosure and untreated razor blades after 20 days of exposure to a hard water solution.
Figure 11:
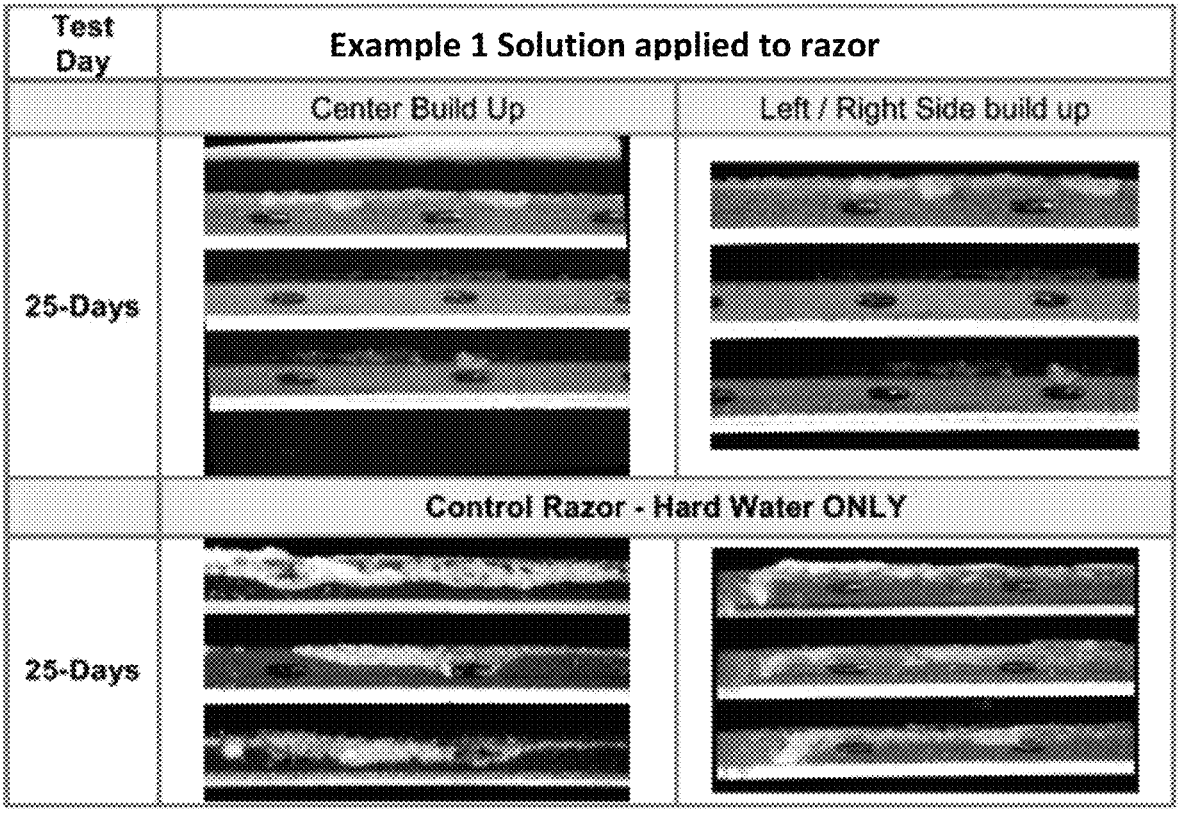
FIG. 11 is a stereoscopic image of razor blades treated with a blade rinsing composition according to one example of the present disclosure and untreated razor blades after 25 days of exposure to a hard water solution.
Figure 12:
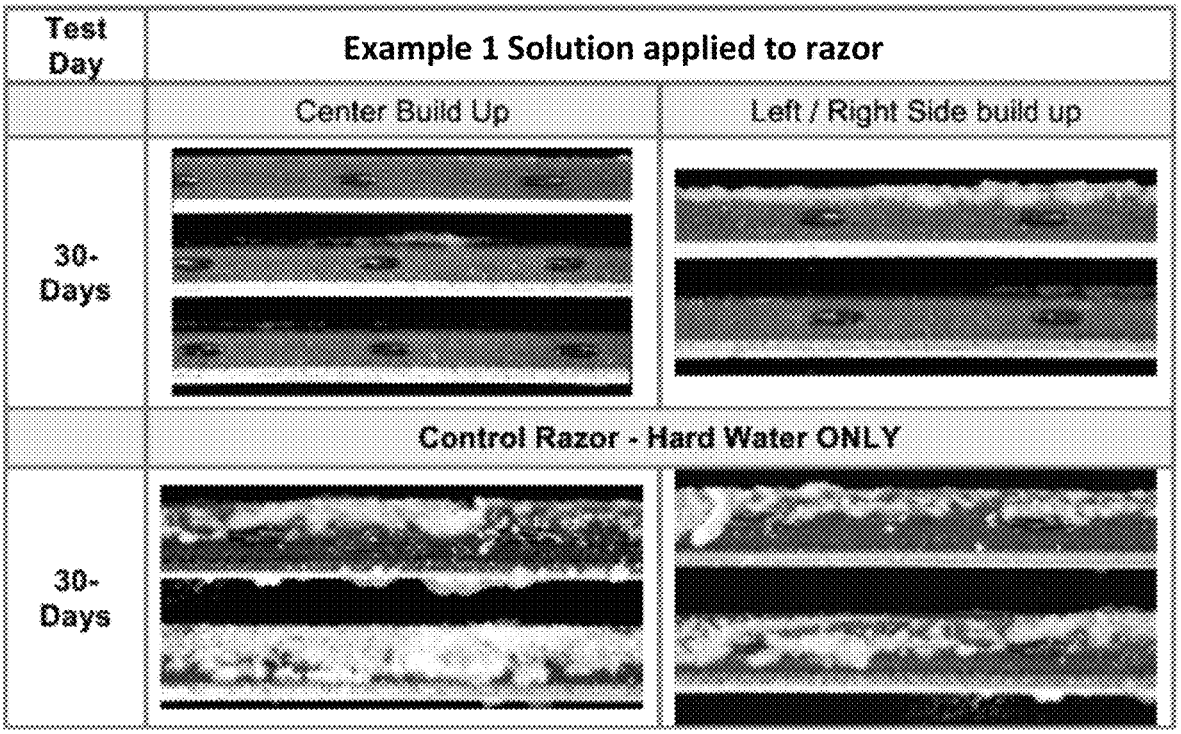
FIG. 12 is a stereoscopic image of razor blades treated with a blade rinsing composition according to one example of the present disclosure and untreated razor blades after 30 days of exposure to a hard water solution.

Starting on day 10, the blades of each razor were imaged stereoscopically for hard water residue deposition. Images were taken of the center section of the blades and of the left/right side of the blades. FIGS. 8-12 show hard water buildup on the razors after 10, 15, 20, 25, and 30 days, respectively, for the two razors. The hard water buildup is shown as white crystalline mineral deposits on the blades. The control razor showed hard water buildup as soon as 10 days into test period, as seen in FIG. 8, where some of the areas of buildup are highlighted with arrows. At each test point, the control razor showed more buildup than the razor treated with the Example 1 solution. The Example 1 solution was effective at reducing hard water buildup over the 30-day test period.

Example 5

A 30-day performance test was conducted on the rinsing solution versus a comparative cleaning formula (Remington Advanced Cleaning Formula PowerClean), with no rinse solution used as a control. The rinsing solution of Example 1 was prepared. A hard water solution was prepared for testing. For the hard water solution, approximately 1200 g of distilled water was mixed with 120 g calcium chloride (Alpha Chemicals) and 90 g of baking soda (Arm & Hammer). The hard water solution was separated into three designated containers. Three Gillette Mach3 razors were obtained, one to be rinsed with the Example 1 solution, one to be rinsed with the comparative solution, and one for control (no solution). The razors were triple-blade.

Figure 13:
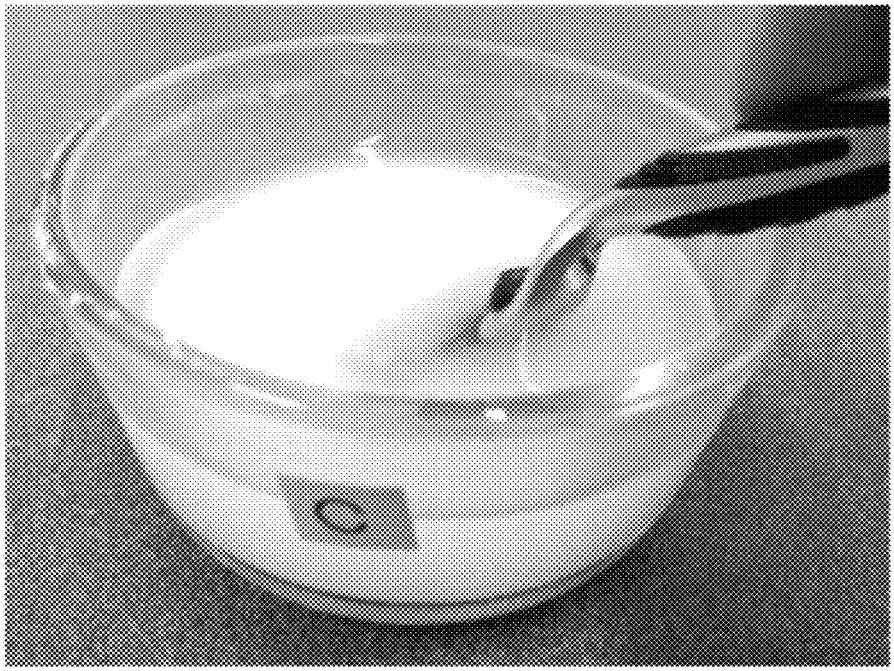
FIG. 13 is a photograph of a test razor dipped in the hard water solution.

Each razor was submerged in the designated hard water solution as shown in FIG. 13, and then tapped on a bowl's edge 2-3 times to remove excess liquid. Each of the test razors were then sprayed with their respective test solution. The control razor was not sprayed. After submersion, all razors were placed in a temperature-controlled chamber set at 125° F. for approximately 1 hour to dry. Each day, the process was repeated.

Figure 14:
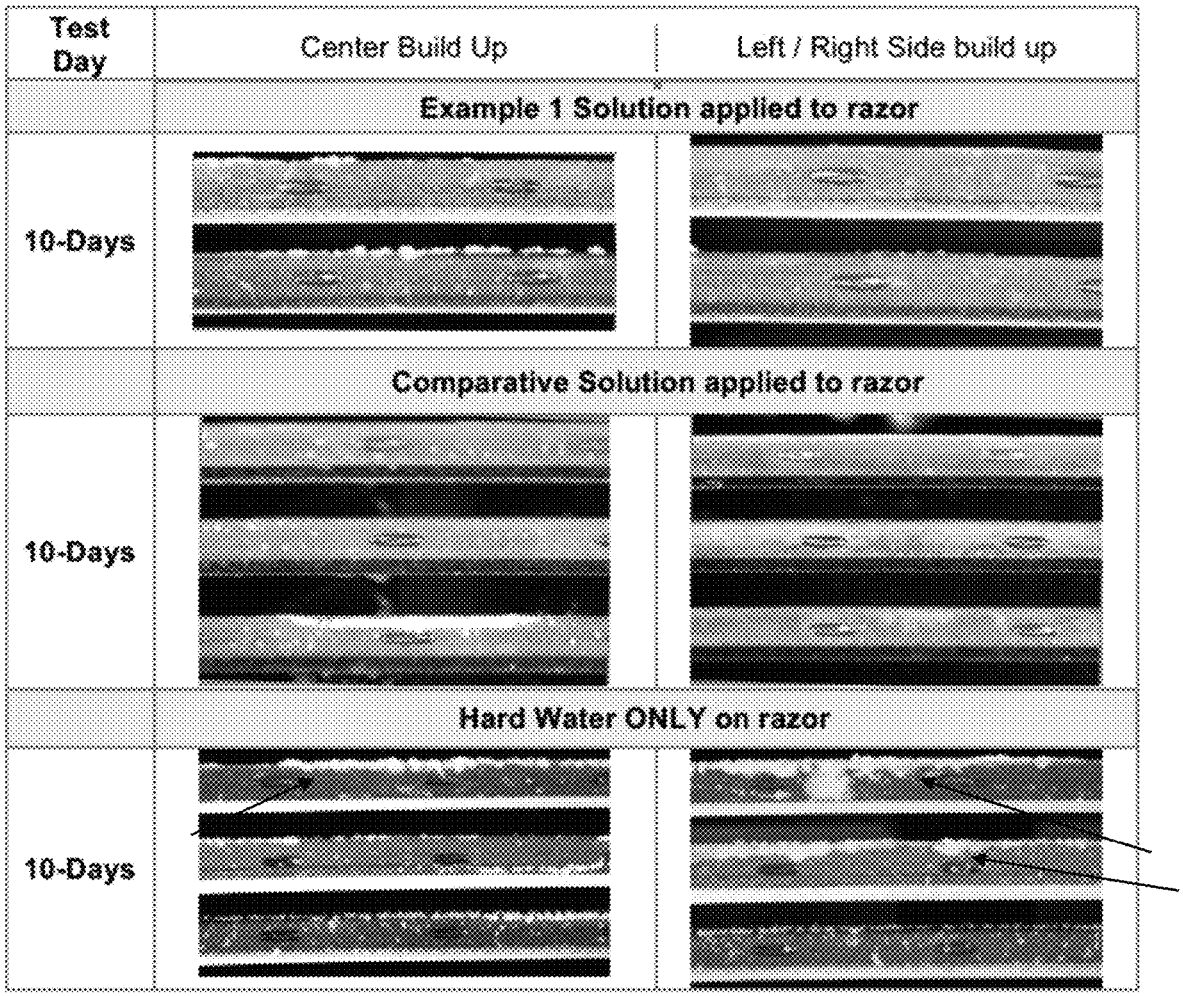
FIG. 14 is a stereoscopic image of razor blades treated with a blade rinsing composition according to one example of the present disclosure, blades treated with a comparative solution, and untreated razor blades after 10 days of exposure to a hard water solution.
Figure 15:
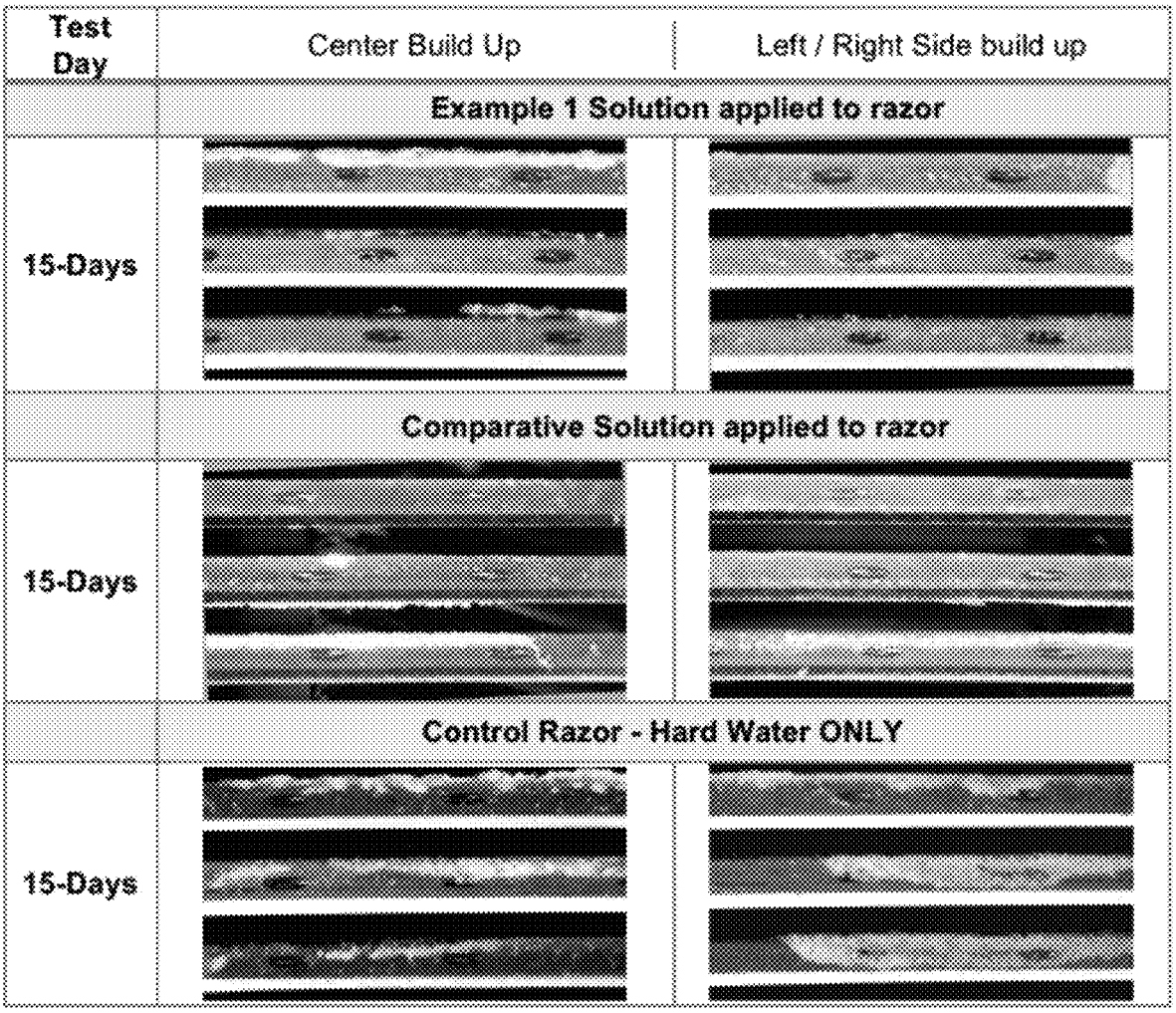
FIG. 15 is a stereoscopic image of razor blades treated with a blade rinsing composition according to one example of the present disclosure, blades treated with a comparative solution, and untreated razor blades after 15 days of exposure to a hard water solution.
Figure 16:
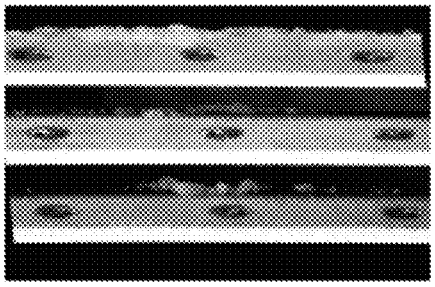
FIG. 16 is a stereoscopic image of razor blades treated with a blade rinsing composition according to one example of the present disclosure, blades treated with a comparative solution, and untreated razor blades after 20 days of exposure to a hard water solution.
Figure 16:
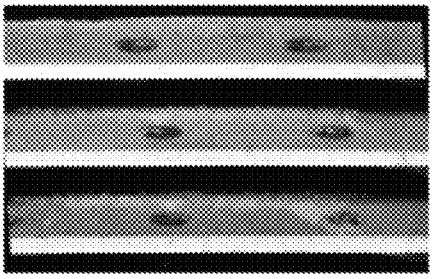
Figure 16:
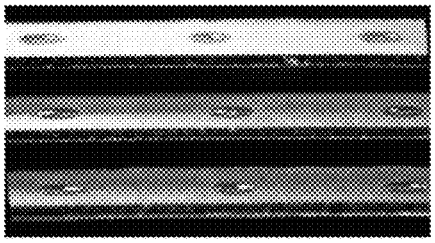
Figure 16:
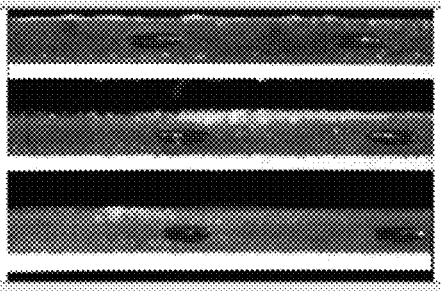
Figure 16:
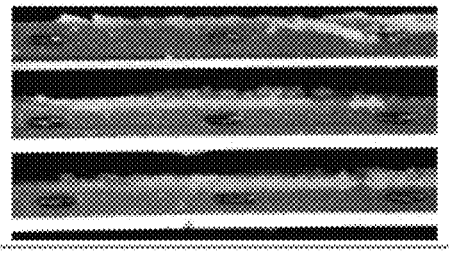
Figure 16:
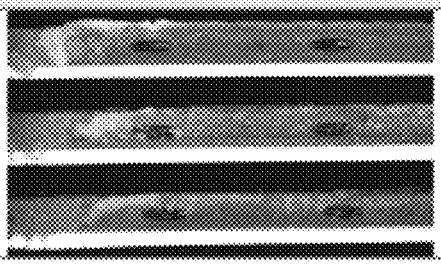
Figure 17:
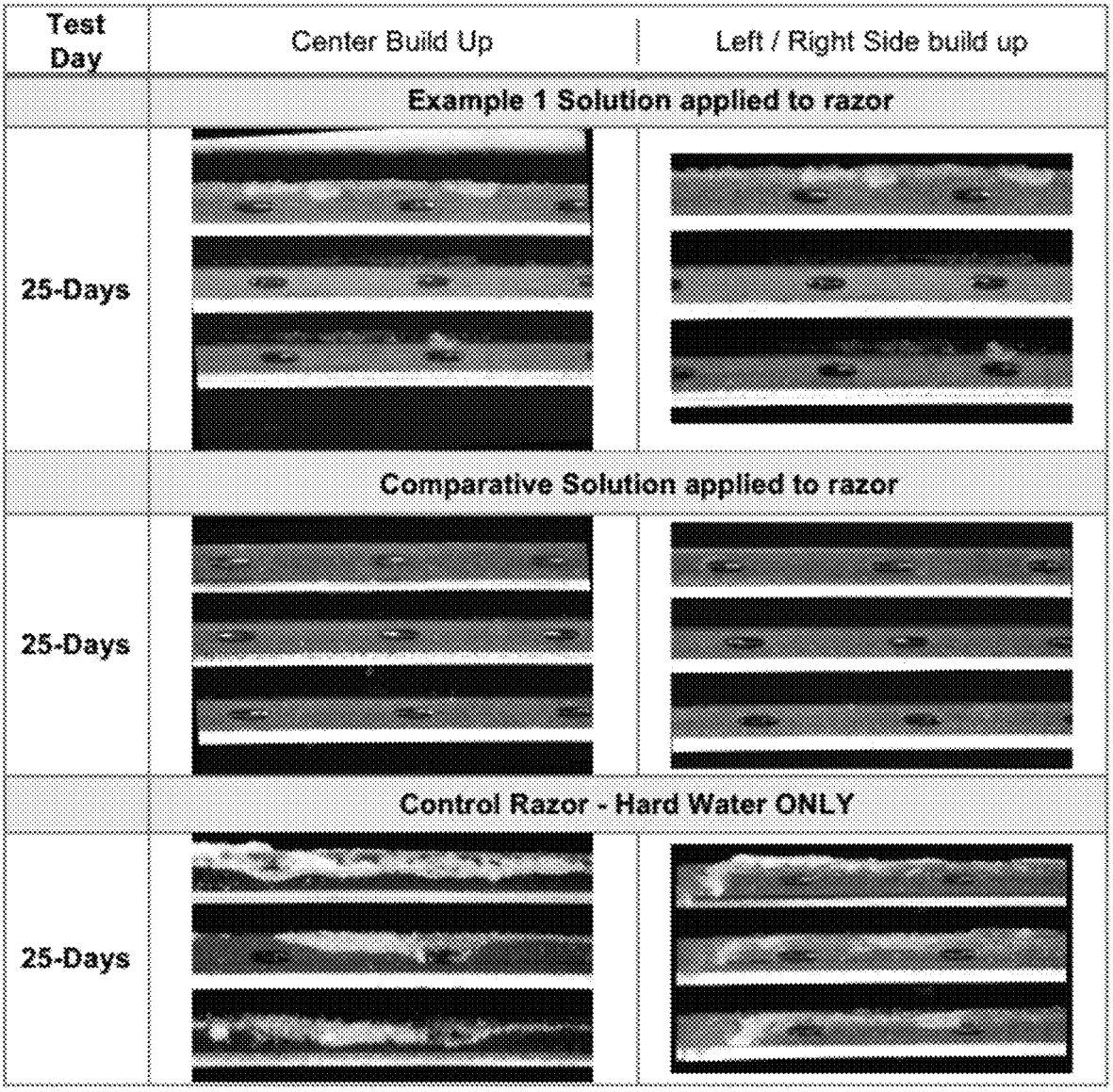
FIG. 17 is a stereoscopic image of razor blades treated with a blade rinsing composition according to one example of the present disclosure, blades treated with a comparative solution, and untreated razor blades after 25 days of exposure to a hard water solution.
Figure 18:
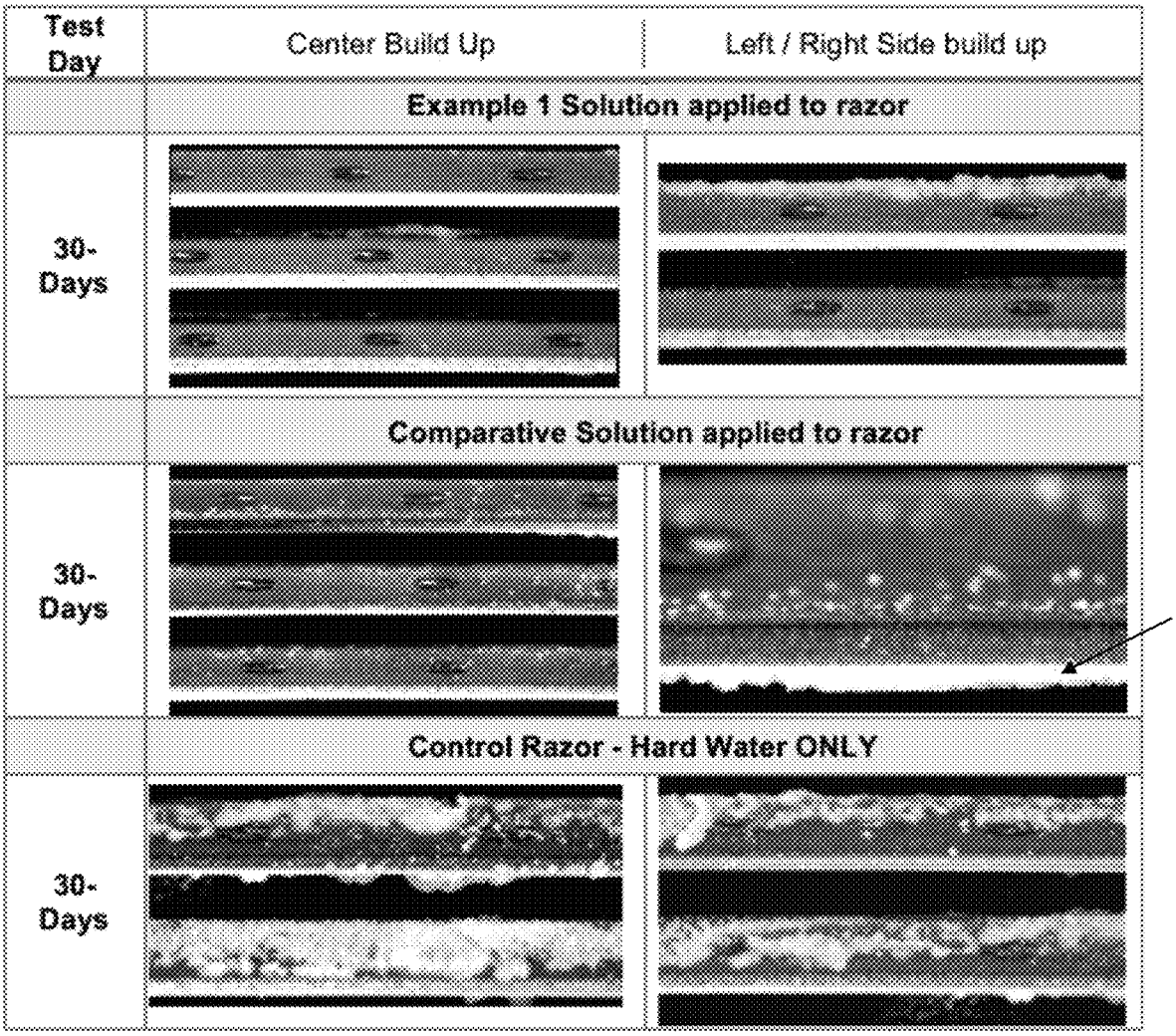
FIG. 18 is a stereoscopic image of razor blades treated with a blade rinsing composition according to one example of the present disclosure, blades treated with a comparative solution, and untreated razor blades after 30 days of exposure to a hard water solution.

Starting on day 10, the blades of each razor were imaged stereoscopically for hard water residue deposition. Images were taken of the center section of the blades and of the left/right side of the blades. FIGS. 14-18 show hard water buildup on the razors after 10, 15, 20, 25, and 30 days, respectively, for all three razors. The Example 1 solution was effective at reducing hard water buildup (mineral crystal deposits) over the 30-day test period. The control razor showed significant hard water buildup as soon as 10 days into test period, as seen in FIG. 14, where some of the areas of buildup are highlighted with arrows. At 30 days, the control razor was substantially coated with the buildup. The comparative solution was effective at reducing hard water buildup (mineral crystal deposits) over the 30-day test period. Buildup on the blade treated with the comparative solution was notable at the blade edges on day 30, as shown in FIG. 18.

Illustrative Embodiments of Suitable Compositions and Methods

As used below, any reference to methods, products, or systems is understood as a reference to each of those methods, products, or systems disjunctively (e.g., "Illustrative embodiment 1-4 is understood as illustrative embodiment 1, 2, 3, or 4.").

In some aspects, compositions, methods, and articles for blade rinse solutions are provided according to one or more of the following examples.

Illustrative embodiment 1 is a blade rinse composition comprising about 0.0001 to 0.01 wt. % disodium tetraborate decahydrate, about 0.0001 to 0.01 wt. % cationic surfactant, up to 5 wt. % anhydrous alcohol and deionized water.

Illustrative embodiment 2 is the composition of any preceding or subsequent illustrative embodiment, wherein the composition comprises about 0.0001 to 0.0005 wt. % disodium tetraborate decahydrate, about 0.0001 to 0.0005 wt. % cationic surfactant, up to 5 wt. % anhydrous alcohol, and deionized water.

Illustrative embodiment 3 is the composition of any preceding or subsequent illustrative embodiment, wherein the cationic surfactant is benzalkonium chloride.

Illustrative embodiment 4 is the composition of any preceding or subsequent illustrative embodiment, wherein the anhydrous alcohol comprises methanol, ethanol, or isopropanol.

Illustrative embodiment 5 is the composition of any preceding or subsequent illustrative embodiment, wherein the deionized water is substantially ion-free.

Illustrative embodiment 6 is the composition of any preceding or subsequent illustrative embodiment, wherein the deionized water has a resistivity of 10-18 megaohm.

Illustrative embodiment 7 is the composition of any preceding illustrative embodiment, wherein the deionized water has a resistivity of 16-18 megaohm.

Illustrative embodiment 8 is a method of making a blade rinse composition compromising obtaining deionized water having a resistivity of 10-18 megaohm, adding disodium tetraborate decahydrate to the deionized water to form a deionized water mixture, preparing a second mixture of cationic surfactant and anhydrous ethanol, and adding the second mixture to the deionized water mixture.

Illustrative embodiment 9 is the method of any preceding or subsequent illustrative embodiment, wherein the cationic surfactant is benzalkonium chloride.

Illustrative embodiment 10 is the method of any preceding or subsequent illustrative embodiment, wherein the anhydrous alcohol comprises methanol, ethanol, or isopropanol.

Illustrative embodiment 11 is the method of any preceding or subsequent illustrative embodiment, wherein the deionized water has a resistivity of 16-18 megaohm.

Illustrative embodiment 12 is the method of any preceding or subsequent illustrative embodiment, further comprising heating the deionized water to a temperature between 40° C. to 60° C.

Illustrative embodiment 13 is the method of any preceding or subsequent illustrative embodiment, further comprising essentially dissolving the disodium tetraborate decahydrate.

Illustrative embodiment 14 is the method of any preceding illustrative embodiment, further comprising agitating the deionized water during the disodium tetraborate decahydrate addition.

Illustrative embodiment 15 is a method for using the composition of claim 1 to minimize deposition of hard water minerals on a metal substrate.

Illustrative embodiment 16 is the method of any preceding or subsequent illustrative embodiment, further comprising spraying the composition on the metal substrate.

Illustrative embodiment 17 is the method of any preceding or subsequent illustrative embodiment, further comprising at least partially submerging the metal substrate in the composition.

Illustrative embodiment 18 is the method of any preceding or subsequent illustrative embodiment, wherein the metal substrate is a razor blade, knife blade, or scissors.

Illustrative embodiment 19 is the method of any preceding illustrative embodiment, wherein the metal substrate is a bathroom fixture or kitchen fixture.

Illustrative embodiment 20 is an article of manufacture comprising any one of the compositions of described herein.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A blade rinse composition comprising:

about 0.0001 to 0.01 wt. % disodium tetraborate decahydrate;

about 0.0001 to 0.01 wt. % cationic surfactant;

up to 5 wt. % anhydrous alcohol; and deionized water.

2. The composition of claim 1, comprising:

about 0.0001 to 0.0005 wt. % disodium tetraborate decahydrate;

about 0.0001 to 0.0005 wt. % cationic surfactant;

up to 5 wt. % anhydrous alcohol; and deionized water.

3. The composition of claim 1, wherein the cationic surfactant is benzalkonium chloride.

4. The composition of claim 1, wherein the anhydrous alcohol comprises methanol, ethanol, or isopropanol.

5. The composition of claim 1, wherein the deionized water is substantially ion-free.

6. The composition of claim 1, wherein the deionized water has a resistivity of 10-18 megaohm.

7. The composition of claim 1, wherein the deionized water has a resistivity of 16-18 megaohm.

8. An article of manufacture comprising the composition of claim 1.

* * * * *